US011866293B2

(12) United States Patent
Keepers

(10) Patent No.: US 11,866,293 B2
(45) Date of Patent: Jan. 9, 2024

(54) AUTOMATED STRING WINDING HANDHELD TOOL

(71) Applicant: Jerry Keepers, Fallon, NV (US)

(72) Inventor: Jerry Keepers, Fallon, NV (US)

( * ) Notice: Subject to any disclaimer, the term of this patent is extended or adjusted under 35 U.S.C. 154(b) by 102 days.

(21) Appl. No.: 17/678,515

(22) Filed: Feb. 23, 2022

(65) Prior Publication Data

US 2022/0306424 A1 Sep. 29, 2022

Related U.S. Application Data

(60) Provisional application No. 63/164,781, filed on Mar. 23, 2021.

(51) Int. Cl.
*B65H 75/40* (2006.01)
*B65H 75/44* (2006.01)

(52) U.S. Cl.
CPC ..... *B65H 75/406* (2013.01); *B65H 75/4486* (2013.01); *B65H 2701/39* (2013.01)

(58) Field of Classification Search
None
See application file for complete search history.

(56) References Cited

U.S. PATENT DOCUMENTS 3,128,962 A * 4/1964 Bieber ..... B65H 75/42 242/396.9
3,784,125 A * 1/1974 Law ..... B65H 75/4486 242/390.8
3,822,839 A * 7/1974 Persichini ..... B65H 75/4486 242/390.8
3,836,859 A * 9/1974 Behrens ..... G05B 19/048 327/292
4,915,320 A * 4/1990 Neal ..... A63H 27/002 242/390.8
5,067,920 A * 11/1991 Brisky ..... B63C 11/26 441/25
5,190,237 A * 3/1993 Fagan ..... B65H 75/305 242/390.8
5,277,350 A * 1/1994 Thornbury, Jr. ..... A63H 27/002 242/390.8
5,695,140 A * 12/1997 Goodman ..... A01K 89/01931 242/310

(Continued)

FOREIGN PATENT DOCUMENTS

CA 2172639 * 1/1997

*Primary Examiner* — William A. Rivera
(74) *Attorney, Agent, or Firm* — Brennan, Manna & Diamond, LLC

(57) ABSTRACT

The present invention relates to a handheld (i.e. single-handedly held) tool for automatically winding string, line, cordage, yarn, thread, and twine onto a spool. The tool includes a handheld and portable threaded mechanism upon which a spool is mounted. Spools of various lengths can be mounted onto the threaded mechanism using a height-adjustable cap. An internal motor is configured to rotate the threaded mechanism and mounted spool for automatically winding string, et. al. A handle of the tool houses rechargeable batteries that are coupled with the internal motor and a push button disposed on the handle activates the motor for rotating the threaded mechanism. The tool includes a USB charging port for receiving a USB cable for recharging the rechargeable batteries.

15 Claims, 6 Drawing Sheets

(56) References Cited

U.S. PATENT DOCUMENTS

| | | | | |
|---|---|---|---|---|
| 6,276,627 | B1 * | 8/2001 | Brodock | B65H 75/06 242/390.8 |
| 6,286,779 | B1 * | 9/2001 | Devine | A61F 15/007 242/390.8 |
| 6,398,147 | B1 * | 6/2002 | Fredrickson | B65H 75/305 242/390.8 |
| 6,648,262 | B1 * | 11/2003 | Huffman | B65H 75/305 242/390.8 |
| 7,198,222 | B2 * | 4/2007 | Rydalch | B65H 75/305 242/608.4 |
| 8,047,461 | B1 * | 11/2011 | Slawson | A01K 89/003 242/227 |
| 8,827,198 | B1 * | 9/2014 | Steadman, Sr. | B65H 75/305 242/613.2 |
| 8,919,690 | B1 * | 12/2014 | Fromm | A01K 89/003 242/390.8 |
| 9,101,850 | B2 * | 8/2015 | Gonzalez | A63H 27/10 |
| 9,643,814 | B2 * | 5/2017 | Feffer | B65H 75/4494 |
| 9,926,169 | B2 * | 3/2018 | Feffer | B65H 75/4492 |
| 10,328,510 | B2 * | 6/2019 | Yamaguchi | B65H 49/36 |
| 11,129,374 | B2 * | 9/2021 | Jaramillo | A01K 89/01931 |
| 11,266,228 | B2 * | 3/2022 | Friend | A46B 13/02 |

* cited by examiner

AUTOMATED STRING WINDING HANDHELD TOOL

CROSS-REFERENCE TO RELATED APPLICATION

The present application claims priority to, and the benefit of, U.S. Provisional Application No. 63/164,781, which was filed on Mar. 23, 2021 and is incorporated herein by reference in its entirety.

FIELD OF THE INVENTION

The present invention relates generally to the field of winding tools. More specifically, the present invention relates to a handheld tool for automated string and twine winding. The tool features a threaded mechanism to mount a spool and an internal motor to rotate the threaded mechanism for enabling the spool to wind a string or thread. The spool on which the string or twine is wound can be easily removed or unwound from the tool. The tool can be used for spools of various dimensions. The device offers an efficient means for individuals to quickly wind string or twine without wasting time in untangling the strings. Accordingly, the present disclosure makes specific reference thereto. Nonetheless, it is to be appreciated that aspects of the present invention are also equally applicable to other like applications, devices, and methods of manufacture.

BACKGROUND

By way of background, string lines and twines are multipurpose and have a wide variety of uses on construction worksites and around the home. Such strings and twines, after a desired application, can be left to lay around, wadded up, and/or thrown away instead of being reused. The strings, when left around, may get tangled and would require a lot of time to untangle and rewind the string line when the string is required for later use/application. Due to the effort and time required for untangling and rewinding the string line, individuals can be reluctant to wind and/or rewind excess or unused string or twine, thereby wasting the string line.

Further, some individuals may try to wrap the string line around a makeshift device and risk tangling. With the use of the makeshift device, trying to untangle the string line for a secondary application can be annoying, time consuming, and frustrating. Also, individuals may desire to have an appropriate device designed especially for winding string or twine, that helps in preventing tangling of strings as well.

Generally, winding of string line is performed manually which takes a lot of effort and time of the user. Individuals with limited physical dexterity and/or elderly users may find it difficult to wind the string line or twine manually and may leave the unused string which then becomes wasted.

Therefore, there exists a long-felt need in the art for a device that enables the users to wind any string line or twine easily and efficiently. There is also a long-felt need in the art for a string winding device that enables the users to wind the string or twine automatically with minimal effort. Further, there is a long-felt need in the art for a device that enables the users to quickly wind the string and therefore saves the time of the user while winding excess used or unused string line or twine. Moreover, there is a long-felt need in the art for a string winding device that is especially designed for winding string and storing it properly in an untangled manner. Further, there is a long-felt need in the art for a string winding device that prevents the string from becoming tangled when left unused. Furthermore, there is a long-felt need in the art for a string winding device that prevents the string from becoming tangled and therefore enables the string to be used for other applications as well. Finally, there is a long-felt need in the art for a string winding device that prevents the users from being annoyed or frustrated while untangling, winding, or rewinding string or twine.

The subject matter disclosed and claimed herein, in one embodiment thereof, comprises a portable tool for automatically winding a string or twine onto a spool. The tool comprising a longitudinal threaded portion for accommodating a spool, a handle attached and positioned below the threaded portion, the handle having a housing for accommodating electronic components, the threaded portion is fastened to the handle at a fixed base cap, the spool is secured between the fixed base cap and an adjustable cap wherein the adjustable cap is mounted to the threaded portion from the top end of the threaded portion, the electronic components include a motor for rotating the threaded portion for rotating the mounted spool, a power source for providing power to the motor, and a USB port for providing power supply for recharging the power source.

In this manner, the automated string and twine winding tool of the present invention accomplishes all of the foregoing objectives and provides users with an automated winding tool for efficiently winding string or twine. The tool eliminates the need to store excess used string in a tangled, loose bundle manner and offers an efficient way for individuals to quickly wind string or twine and to allow for future use without spending time untangling the product. The device prevents string and twine from becoming tangled when left unused.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a handheld tool for automatically winding a string or twine onto a spool. The tool comprising a threaded portion for accommodating a spool, a handle having a housing for accommodating electronic components, the threaded portion is fastened to the handle at a fixed base cap, the spool is secured between the fixed base cap and an adjustable cap wherein the adjustable cap is mounted to the threaded portion from the top end of the threaded portion, the electronic components include a motor for rotating the threaded portion for rotating the mounted spool, a power source for providing power to the motor, and a USB port for providing a power supply for recharging the power source.

In yet another embodiment, a device for automatically winding a loose string or twine onto a spool is disclosed. The device includes a handle having a housing, a threaded portion removably fastened on the top of the handle, an adjustable cap configured to mounted on the threaded portion, the threaded portion is used for mounting a spool between the adjustable cap and the handle, the housing having a motor coupled to the threaded portion wherein the motor rotates the threaded portion to rotate mounted spool in, for example, a clockwise or counterclockwise direction for winding string or twine. The motor is activated when a power button disposed on the housing is pressed enabling a power supply from a battery of the tool to the motor.

In yet another embodiment the spool has a quick disconnect to the motor so it can be used for other applications for various tools and spool sizes.

In yet another embodiment, the housing includes a USB female port for receiving a USB male connector for providing power to recharge the battery of the tool.

In yet another embodiment, the battery is a rechargeable Lithium-Ion battery.

In yet another embodiment, the battery is a rechargeable Nickel-Cadmium battery.

In yet another embodiment, the motor includes a built-in gear system.

In yet another embodiment, the adjustable-height cap runs along the threaded portion for accommodating spools of various sizes.

In yet another embodiment, the motor is a miniature motor.

In yet another embodiment, a method for automatically winding loose string or twine onto a spool is described. The method includes providing a handheld tool, the handheld tool including a central threaded portion, an adjustable-height cap and a handle, the handle having an internal motor for rotating the central threaded portion; mounting a spool on threaded portion and securing the spool by mounting the adjustable-height cap; pressing a push button disposed on the handle; activating internal motor to rotate the threaded portion and mounted spool; and, winding the string or twine onto the spool.

In yet another embodiment, the method includes removing the adjustable-height cap from the threaded portion and removing the spool from the threaded portion.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
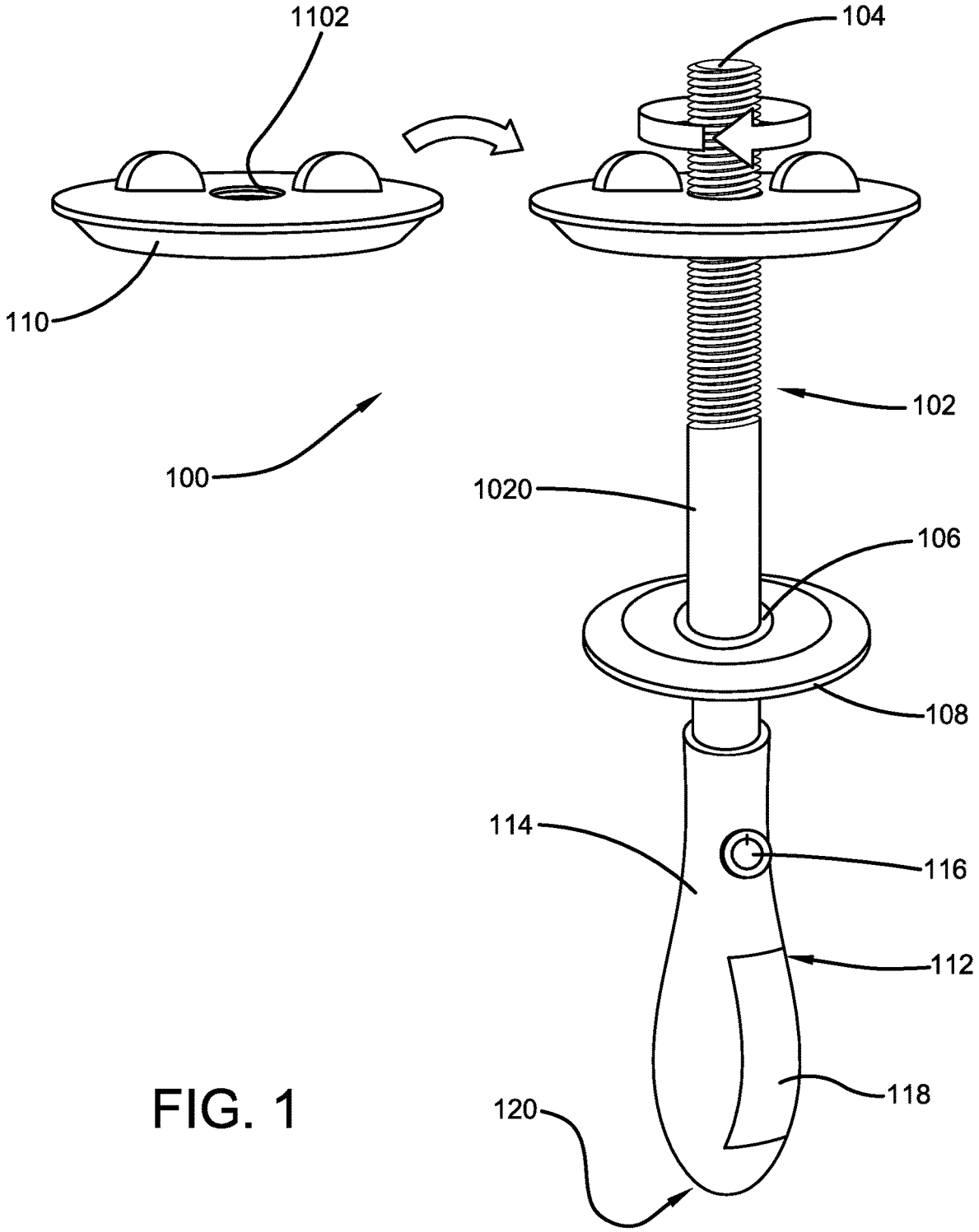
FIG. 1 illustrates a perspective view of one potential embodiment of an automated string winding tool of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It can be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments can be combined.

As noted above, there is a long-felt need in the art for a device that enables the users to wind any string line or twine easily and efficiently. There is also a long-felt need in the art for a string winding device that enables the users to wind the string or twine automatically with minimal effort. Further, there is a long-felt need in the art for a device that enables the users to quickly wind the string and therefore saves the time of the user while winding excess used or unused string line or twine. Moreover, there is a long-felt need in the art for a string winding device that is especially designed for winding string and storing it properly in an untangled manner. Further, there is a long-felt need in the art for a string winding device that prevents the string from becoming tangled when left unused. Furthermore, there is a long-felt need in the art for a string winding device that prevents the string from becoming tangled and therefore enables the string to be used for other applications as well. Finally, there is a long-felt need in the art for a string winding device that prevents the users from being annoyed or frustrated while untangling, winding, or rewinding string or twine.

The present invention, in one exemplary embodiment, is a novel method for automatically winding a loose string or twine onto a spool is described. The method includes providing a handheld tool, the handheld tool including a central threaded portion, an adjustable-height cap and a handle, the handle having an internal motor for rotating the central threaded portion; mounting a spool on the threaded portion and securing the spool by mounting the adjustable-height cap; pressing a push button disposed on the handle; activating an internal motor to rotate the threaded portion and mounted spool; and, winding the string or twine onto the spool.

Referring initially to the drawings, FIG. 1 illustrates a perspective view of one potential embodiment of an automated string winding tool 100 of the present invention in accordance with the disclosed architecture. The automated string winding tool 100 is a handheld tool designed for winding excess used or unused string and twine onto a spool. The tool 100 can be used with a variety of spools which are removably placed on the tool as described later in the disclosure. More specifically, the tool 100 includes a threaded portion 102 configured to receive and accommodate a spool for winding string, thread, twine, cordage, yarn, or line (i.e. fishing or weed trimmer). The threaded portion 102 includes a top end 104 and a bottom end 106 wherein the bottom end 106 is removably fastened to a fixed base cap 108. A height-adjustable cap 110 is removably mounted to the threaded portion 102 from the top end 104 where the height-adjustable cap 110 may run along the threaded portion 102 to adjust distance between the height-adjustable cap 110 and the fixed base cap 108 for securing spools of various lengths.

The tool 100 includes a handle 112 configured to be single-handedly held by a user during operation of the tool 100. The handle 112 includes a housing 114 for housing electronic circuitry and components for operating the tool 100 as described in FIGS. 4 and 5. A power button 116 is disposed on the housing 114 for activating and deactivating the tool 100 and more specifically, rotation of the threaded portion 102. In specific embodiments, when the power button 116 is pressed, then, the threaded portion 102 is rotated at a predetermined speed to rotate a spool mounted on the threaded portion 102. Thereafter, when the power button 116 is again pressed, rotation of the threaded portion 102 is stopped. The housing 114 includes a battery cover 118 for protecting the rechargeable batteries disposed in the battery socket. At the bottom end 120 of the handle 112, a USB charging port 122 (shown in FIG. 4) is disposed for recharging the rechargeable batteries.

In the present embodiment, the fixed base cap 108 is an integral part of the handle 112 and alternatively, the fixed base cap 108 can be removably attached to the handle 112. The height-adjustable cap 110 includes a threaded central hole 1102 dimensioned as per the diameter of the threaded portion 102 enabling the cap 110 to threadingly move along the length of the threaded portion 102.

The handheld tool 100 is preferably made from cast iron, aluminum, heavy-duty plastic, or any other durable and lightweight material. The threaded portion 102 may have threads along the complete longitudinal length or may have a planar surface 1020 along a portion of the longitudinal length of the threaded portion 102.

Figure 2:
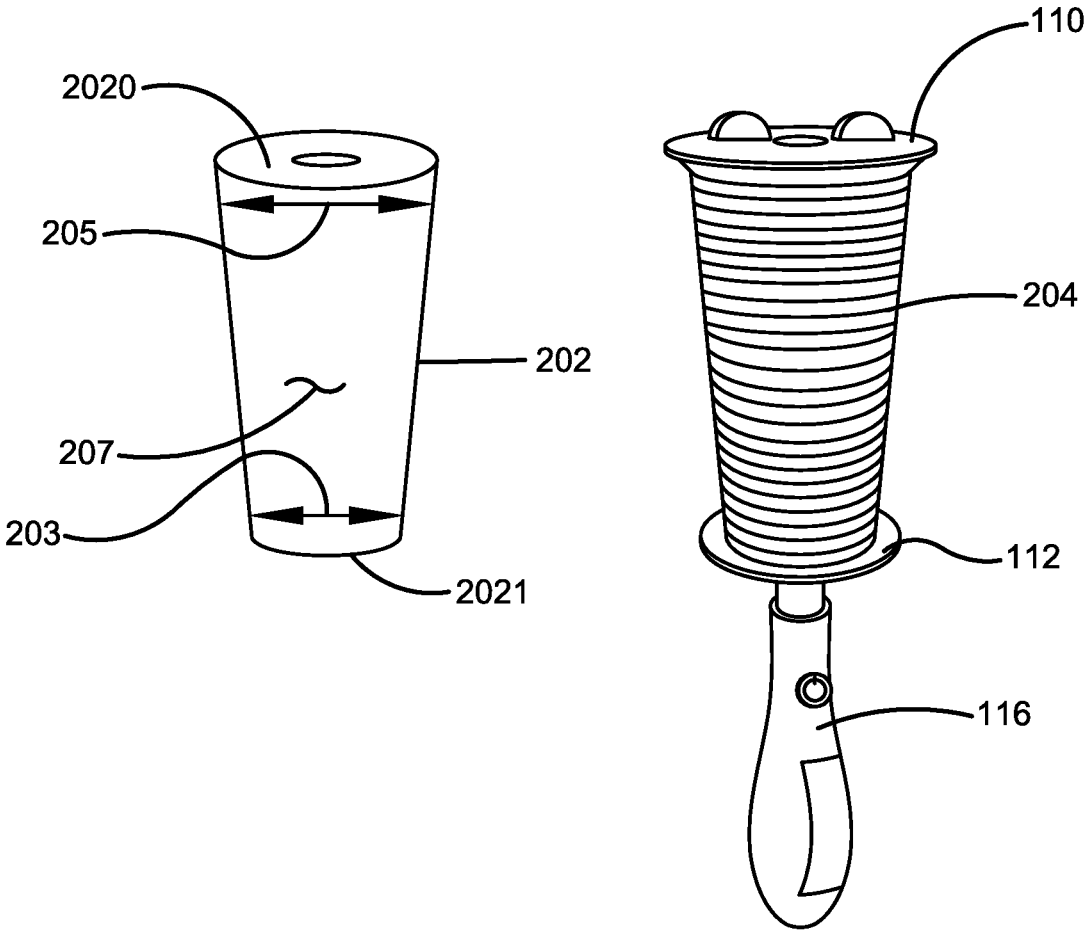
FIG. 2 illustrates a perspective view showing a spool secured to the threaded portion of the handheld tool of the present invention in accordance with the disclosed architecture.

FIG. 2 illustrates a perspective view showing a spool secured to the threaded portion of the handheld tool 100 of the present invention in accordance with the disclosed architecture. As shown, a spool 202 for a desired string, thread, twine, cordage, yarn, or line 204 is positioned and secured on the threaded portion 102 between the adjustable cap 110 and the fixed base cap 108. The adjustable cap 110 is supported on the top end 2020 of the spool 202. The spool 202 includes a lower diameter 203, an upper diameter 205, and an outer perimeter 207 extending between the top end 2020 and a bottom end 2021 of the spool 202. The upper diameter 205 is greater than the lower diameter 203. It is to be appreciated that the outer perimeter 207 tapers from the top end 2020 to the bottom end 2021. When the power button 116 is pressed, the spool 202 is rotated in, for example, a counterclockwise direction to wind unused or excessive string, thread, twine, cordage, yarn, or line (i.e. fishing or weed trimmer) onto the spool 202.

Figure 3:
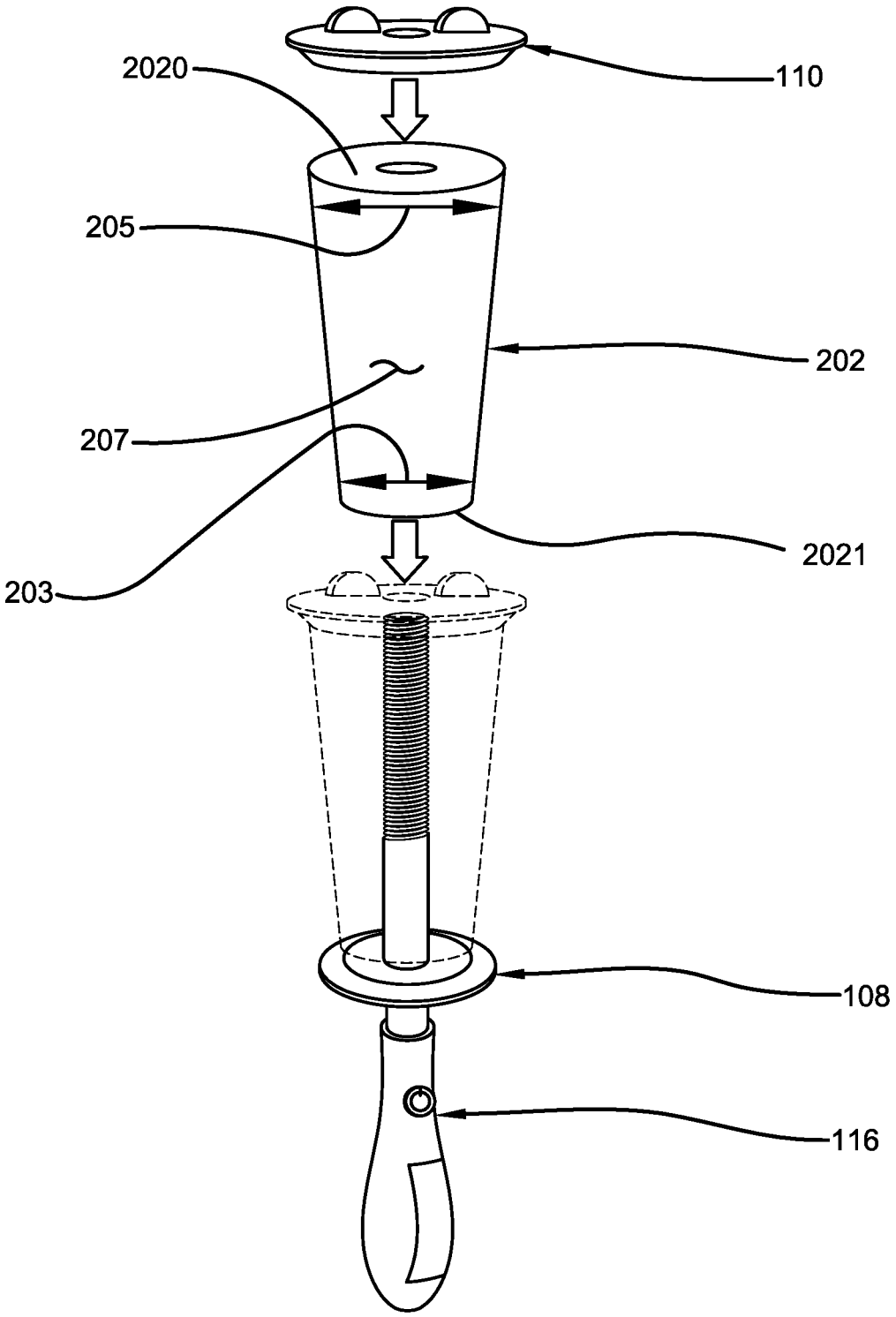
FIG. 3 illustrates a perspective view showing the process of mounting the exemplary spool to the threaded portion for use with the handheld tool of the present invention in accordance with the disclosed architecture.

FIG. 3 illustrates a perspective view showing the process of mounting the exemplary spool 202 to the threaded portion 102 for use with the handheld tool 100 of the present invention in accordance with the disclosed architecture. For mounting the spool 202, the adjustable cap 110 is removed such that the spool 202 is positioned on the threaded portion 102 as shown in dashed lines. One end 2022 of the spool 202 is supported by the base cap 108 and when the spool 202 is mounted, the adjustable cap 110 is installed onto the threaded portion 102 to a desired height such that the spool 102 is secured between the base cap 108 and the adjustable cap 110. The push button 116 when pressed, enables the threaded portion 102 to rotate, thereby enabling the spool 202 to rotate for efficiently winding string, thread, twine, cordage, yarn, or line (i.e. fishing or weed trimmer) onto the spool 202. Once the winding is complete, the spool 202 can be removed by removing the adjustable cap 110 and removing the spool 202 from the threaded portion 102.

An advantage of the string keeper tool 100 of the present invention is that the tool 100 can be single-handedly used for a variety of spools, including a variety of lengths of spools, while obviating manual winding of the string, thread, twine, cordage, yarn, or line (i.e. fishing or weed trimmer).

Figure 4:
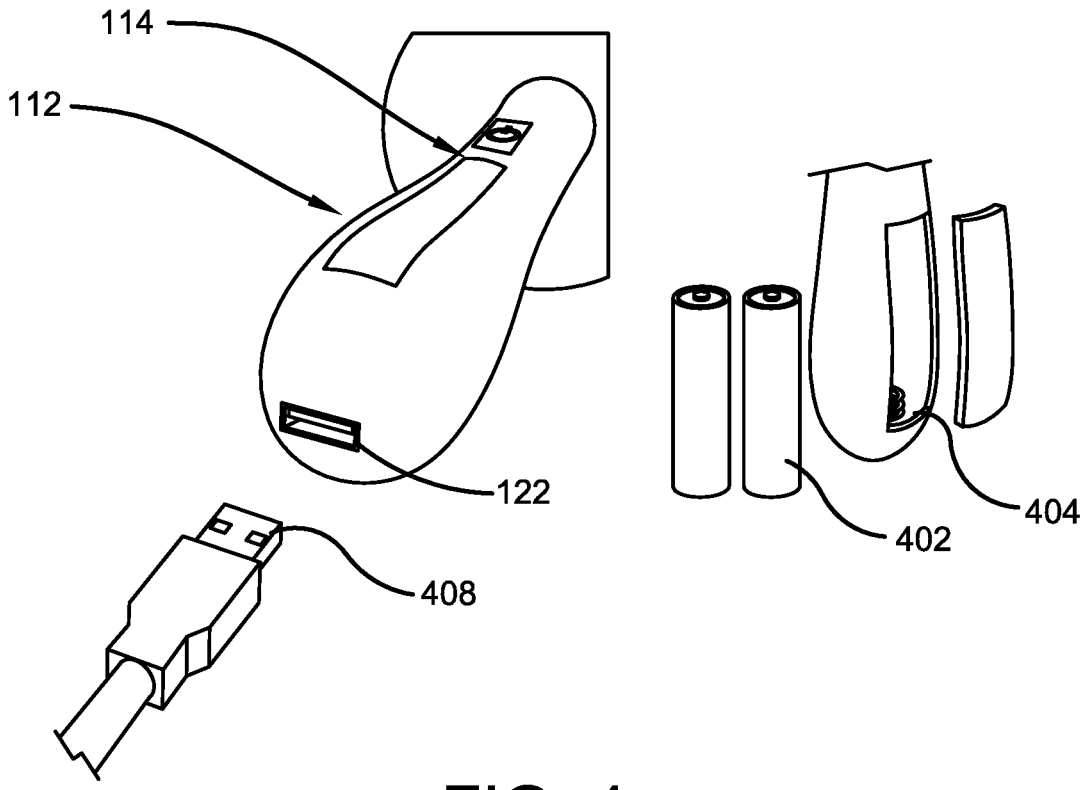
FIG. 4 illustrates an enlarged view of the handle of the string keeper tool of the present invention showing a USB charging port and the batteries used in the tool in accordance with the disclosed architecture.

FIG. 4 illustrates an enlarged view of the handle 112 of the string keeper tool 100 of the present invention showing a USB charging port and the batteries used in the tool in accordance with the disclosed architecture. The single-handed tool 100 is powered using the rechargeable batteries 402 positioned in the battery socket 404 disposed in the housing 114 of the handle 112. The rechargeable batteries 402 are housed wholly within the housing 114 and are used for providing electric power to the motor 502 (shown in FIG. 5). The motor produces the rotation of the central threaded portion 102 for rotating the spool in order to wind string, thread, twine, cordage, yarn, or line (i.e. fishing or weed trimmer).

The USB female port 122 positioned at the bottom 120 of the handle 112 is used for receiving a conventional USB charging cable 406 for providing electric power to recharge the rechargeable batteries 402. More specifically, the USB female port 122 receives the wire's USB-male plug 408 to deliver electric power.

The USB port 122 in the present invention can accommodate any suitable power-in supply, a non-limiting example of which includes a USB power supply of 5V-500 mA, such as that provided by a computer or other USB charging device. Also, a 110 Volt AC wall charger can be utilized with a 5 Volt output and a 500 mA charge rate.

The rechargeable batteries 402 can be Lithium-Ion rechargeable batteries or Nickel-Cadmium rechargeable batteries.

Figure 5:
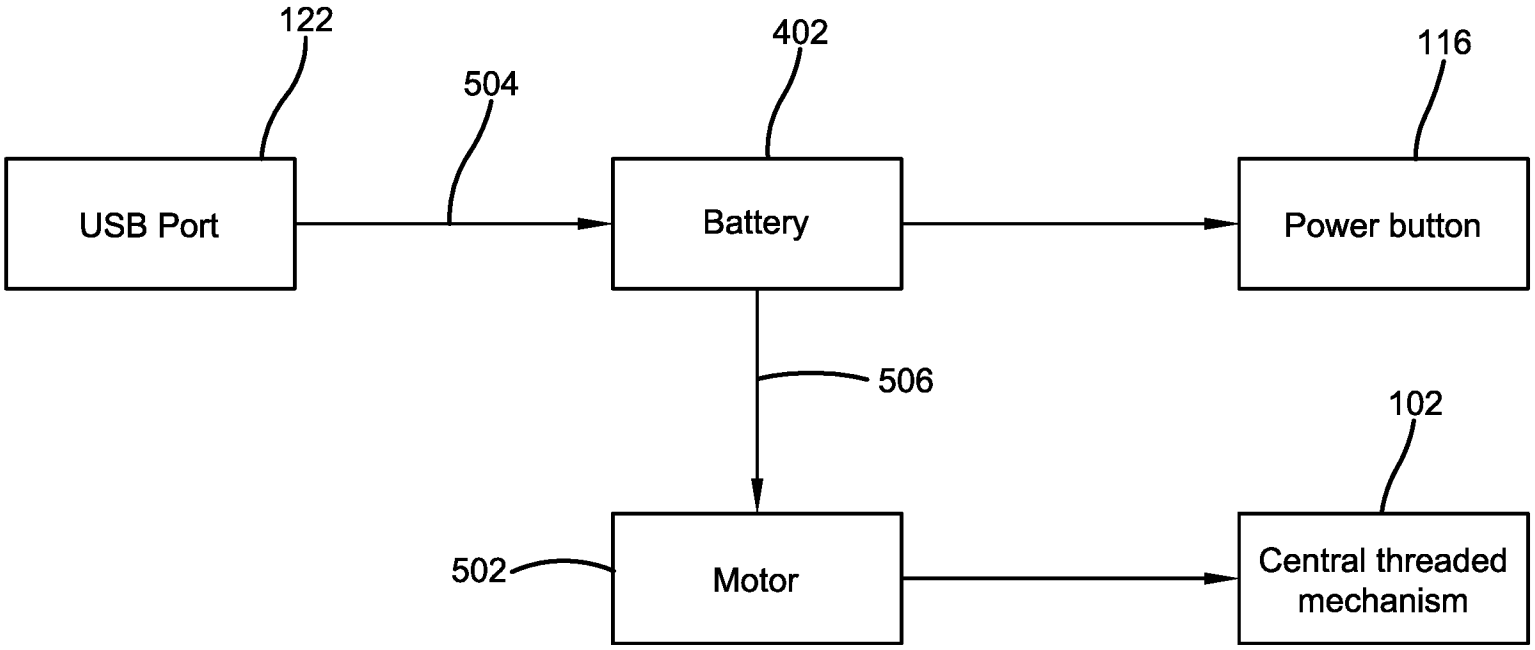
FIG. 5 illustrates a connection diagram showing electric connections in the handheld tool of the present invention in accordance with the disclosed architecture.

FIG. 5 illustrates a connection diagram showing electric connections in the handheld tool 100 of the present invention in accordance with the disclosed architecture. The USB port 122 is connected to the battery 402 using a first power line 504 through which the USB port 122 provides electric power to recharge the batteries 402. The battery 402 is configured to provide electric power to the motor 502 when the power button 116 is pressed by a user. Upon pressing the power button 116, the second power line 506 between the battery 402 and the motor 502 is closed enabling electric power to supply to the motor 502. When the power button 116 is pressed again, the second power line 506 becomes an open circuit to shut off the power supply from the battery 402 to the motor 502.

The motor 502 is coupled to the central threaded mechanism or portion 102 and is configured to rotate the central threaded mechanism 102 in counterclockwise direction to wind string, thread, twine, cordage, yarn, or line (i.e. fishing or weed trimmer).

In one embodiment, the motor 502 can provide rotation of the central threaded mechanism 102 at a constant speed. In alternative embodiments, the motor 502 can be associated with an internal gear system that may change the rotating speed of the central threaded mechanism 102.

The motor 502 of the tool 100 is selected to provide sufficient torque to wind even a heavy string or twine. The motor 502 can be any suitable motor that is small enough to be incorporated into the housing 114 and provide a suitable torque and rotation. As a non-limiting example, the motor 502 can be a miniature motor that is capable of 300 rpm, plus or minus 100 rpm. The motor 502 can generally be activated, only when the power button 116 is pressed.

Figure 6:
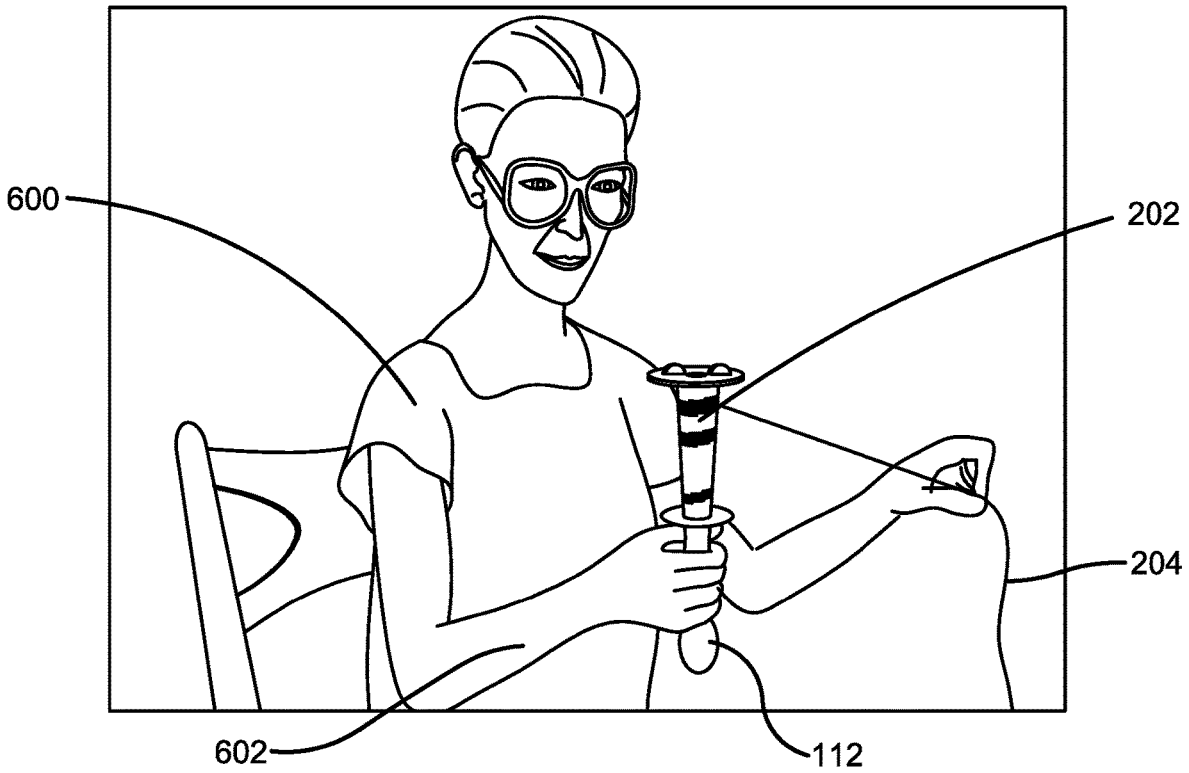
FIG. 6 illustrates a perspective view showing a user using the string winding tool of the present invention for winding string or twine in accordance with the disclosed architecture.

FIG. 6 illustrates a perspective view showing a user 600 using the string winding tool 100 of the present invention for winding string or twine in accordance with the disclosed architecture. As shown, the user 600 can single-handedly hold and operate the tool 100 with the handle 112 thereby enabling the spool 202 mounted to the threaded portion to rotate freely. The user 600 can easily hold the handle 112 in a single hand 602 and when the power button 116 is pressed, the spool 202 is rotated to wind the string, thread, twine, cordage, yarn, or line (i.e. fishing or weed trimmer) 204.

The tool 100 can be used for securing spools having lengths in the range from about 3 cm to about 20 cm, and in one embodiment, the tool 100 can be used for unwinding a spooled string, thread, twine, cordage, yarn, or line. The tool 100 may come in a variety of colors.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "handheld tool", "tool", "string keeper tool", "automated string winding tool", and "string winding tool" are interchangeable and refer to the automated string winding tool 100 of the present invention.

Notwithstanding the forgoing, the automated string winding tool 100 of the present invention can be of any suitable size and configuration as is known in the art without affecting the overall concept of the invention, provided that it accomplishes the above-stated objectives. One of ordinary skill in the art will appreciate that the automated string winding tool 100 as shown in the FIGS. are for illustrative purposes only, and that many other sizes and shapes of the automated string winding tool 100 are well within the scope of the present disclosure. Although the dimensions of the automated string winding tool 100 are important design parameters for user convenience, the automated string winding tool 100 can be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A handheld automated string winding tool comprising:

a selectable spool removably placed on said winding tool and a threaded portion configured to receive and accommodate said selectable spool for winding said string;

wherein said threaded portion includes a top end and a bottom end, wherein said bottom end is removably fastened to a fixed base cap;

a height-adjustable cap removably mounted to said threaded portion from said top end, wherein said height-adjustable cap rotates along said threaded portion for adjusting a distance between said height-adjustable cap and said fixed base cap for securing said selectable spool therebetween; and a handle configured to be held by a user during operation of said winding tool, wherein said handle includes a housing for housing an electronic circuitry, a power button, and a power source for rotating said threaded portion; and wherein said selectable spool comprises a lower diameter that is smaller than a diameter of said fixed base cap and an upper diameter that is smaller than a diameter of said height-adjustable cap; and wherein said height-adjustable cap comprises a threaded central hole dimensioned to threadingly move along a length of said threaded portion; and wherein said power button activates and deactivates said winding tool; and wherein activation of said winding tool rotates said threaded portion to rotate said selectable spool in a counterclockwise direction.

2. The handheld automated string winding tool of claim 1, wherein said power source is a rechargeable battery and a USB charging port for recharging said rechargeable battery.

3. The handheld automated string winding tool of claim 1, wherein said string is selected from a group consisting of a thread, a twine, a cordage, a yarn, and a line.

4. The handheld automated string winding tool of claim 3, wherein said distance is adjustable from about 3 cm to about 20 cm.

5. The handheld automated string winding tool of claim 1, wherein said selectable spool includes a length from about 3 cm to about 20 cm.

6. A handheld winding tool comprising:

a selectable spool removably placed on said winding tool and a threaded portion configured to receive and accommodate said selectable spool for winding a cordage;

wherein said threaded portion includes a top end and a bottom end, wherein said bottom end is fastened to a fixed base cap;

a height-adjustable cap removably mounted to said threaded portion from said top end, wherein said height-adjustable cap rotates along said threaded portion for adjusting a distance between said height-adjustable cap and said fixed base cap for securing said selectable spool therebetween;

wherein said selectable spool includes a first lower diameter and a second upper diameter, and further wherein said second upper diameter is larger than said first lower diameter; and a handle configured to be held by a user during operation of said winding tool, wherein said handle includes a housing for housing an electronic circuitry, a power button, and a power source for rotating said threaded portion; and wherein said first lower diameter of said selectable spool is smaller than a diameter of said fixed base cap and said second upper diameter of said selectable spool is smaller than a diameter of said height-adjustable cap; and wherein said height-adjustable cap comprises a threaded central hole dimensioned to threadingly move along a length of said threaded portion; and wherein said power button activates and deactivates said winding tool; and wherein activation of said winding tool rotates said threaded portion to rotate said selectable spool in a counterclockwise direction.

7. The handheld winding tool of claim 6, wherein said selectable spool includes an outer perimeter, and said outer perimeter tapers from said second upper diameter to said first lower diameter.

8. The handheld winding tool of claim 7, wherein said power source is a rechargeable battery and a USB charging port for recharging said rechargeable battery.

9. The handheld winding tool of claim 6, wherein said cordage is selected from a group consisting of a string, a thread, a twine, a yarn, and a line.

10. The handheld winding tool of claim 9, wherein said distance is adjustable from about 3 cm to about 20 cm.

11. The handheld winding tool of claim 10, wherein said fixed base cap is integral with said handle.

12. The handheld winding tool of claim 6, wherein said selectable spool includes a length from about 3 cm to about 20 cm.

13. A single-handed winding tool comprising:

a selectable spool removably placed on said single-handed winding tool, wherein said single-handed winding tool includes a threaded portion configured to receive and accommodate said selectable spool for winding a cordage;

wherein said threaded portion includes a top end and a bottom end, wherein said bottom end is fastened to a fixed base cap;

a height-adjustable cap removably mounted to said threaded portion from said top end, wherein said height-adjustable cap rotates along said threaded portion for adjusting a distance between said height-adjustable cap and said fixed base cap for securing said selectable spool therebetween;

wherein said selectable spool includes a first lower diameter and a second upper diameter, and further wherein said second upper diameter is larger than said first lower diameter;

wherein said selectable spool includes an outer perimeter, and said outer perimeter tapers from said second upper diameter to said first lower diameter;

a handle configured to be held by a user during operation of said single-handed winding tool, wherein said handle includes a housing for housing an electronic circuitry, a power button, and a power source for rotating said threaded portion;

wherein said power button activates and deactivates said single-handed winding tool; and further wherein said activating said single-handed winding tool includes rotation of said threaded portion to rotate said selectable spool; and wherein said first lower diameter of said selectable spool is smaller than a diameter of said fixed base cap and said second upper diameter of said selectable spool is smaller than a diameter of said height-adjustable cap; and wherein said height-adjustable cap comprises a threaded central hole dimensioned to threadingly move along a length of said threaded portion.

14. The single-handed winding tool of claim 13, wherein said cordage is selected from a group consisting of a string, a thread, a twine, a yarn, and a line.

15. The single-handed winding tool of claim 14, wherein said distance is adjustable from about 3 cm to about 20 cm.

* * * * *